US009302278B2

(12) United States Patent
Huang

(10) Patent No.: US 9,302,278 B2
(45) Date of Patent: Apr. 5, 2016

(54) NOZZLE OF SPRAY GUN

(71) Applicant: Tsung Mao Industrial Co., Ltd., New Taipei (TW)

(72) Inventor: Jung-Kun Huang, New Taipei (TW)

(73) Assignee: Tsung Mao Industrial Co., Ltd., New Taipei (TW)

( * ) Notice: Subject to any disclaimer, the term of this patent is extended or adjusted under 35 U.S.C. 154(b) by 133 days.

(21) Appl. No.: 14/289,661

(22) Filed: May 29, 2014

(65) Prior Publication Data

US 2015/0343462 A1 Dec. 3, 2015

(51) Int. Cl.

| | |
|---|---|
| ***B05B 1/28*** | (2006.01) |
| ***B05B 1/04*** | (2006.01) |
| ***B05B 7/24*** | (2006.01) |
| ***B05B 7/30*** | (2006.01) |
| ***B05B 1/00*** | (2006.01) |
| ***B05B 15/06*** | (2006.01) |
| ***B05B 7/06*** | (2006.01) |
| ***B05B 7/04*** | (2006.01) |
| ***B05B 7/08*** | (2006.01) |
| ***B05B 9/04*** | (2006.01) |
| ***B05B 11/00*** | (2006.01) |

(52) U.S. Cl.

CPC ..... *B05B 1/042* (2013.01); *B05B 1/005* (2013.01); *B05B 7/04* (2013.01); *B05B 7/06* (2013.01); *B05B 7/0815* (2013.01); *B05B 7/2405* (2013.01); *B05B 7/2416* (2013.01); *B05B 7/2429* (2013.01); *B05B 7/30* (2013.01); *B05B 9/0403* (2013.01); *B05B 11/00* (2013.01); *B05B 15/065* (2013.01); *Y10S 239/14* (2013.01)

(58) Field of Classification Search

CPC ..... B05B 1/042; B05B 7/2405; B05B 7/30; B05B 1/005; B05B 7/06; B05B 7/04; B05B 15/065; B05B 7/0815; B05B 7/2416; B05B 9/0403; B05B 11/00; B05B 7/2429; Y10S 239/14

USPC ..... 239/290, 296, 340, 351, 355, 373, 239/417.3, 423, 433, 375, 600, DIG. 14, 239/300

See application file for complete search history.

(56) References Cited

U.S. PATENT DOCUMENTS

| | | | | | |
|---|---|---|---|---|---|
| 5,217,168 | A * | 6/1993 | Svendsen | B05B 7/083 | 239/300 |
| 5,456,414 | A * | 10/1995 | Burns | B05B 7/0081 | 239/296 |
| RE40,433 | E * | 7/2008 | Schmon | B05B 7/1209 | 239/296 |
| 8,113,445 | B2 * | 2/2012 | Drozd | B05B 7/066 | 239/296 |
| 8,550,376 | B2 * | 10/2013 | Munn | B05B 7/0815 | 239/290 |

* cited by examiner

*Primary Examiner* — Steven J Ganey

(74) *Attorney, Agent, or Firm* — C. G. Mersereau; Nikolai & Mersereau, P.A.

(57) ABSTRACT

A nozzle of a spray gun includes an air cap, a board, a cover and a nozzle. The air cap has a central path. The central path has a first inner periphery and a second inner periphery which is larger than the first inner periphery. Two guide faces each are a tapered face which is connected between the first and second inner peripheries of the central path of the air cap. The two guide faces are located symmetrically relative to the central path. Two air holes are respectively defined between the two guide faces and the nozzle. The air flow from the guide faces interests the air flow form the air holes to increase the range of the air flow to guide the paint in the paint path to be ejected from the nozzle.

2 Claims, 8 Drawing Sheets

NOZZLE OF SPRAY GUN

BACKGROUND OF THE INVENTION (1) Fields of the Invention

The present invention relates to a nozzle of a spray gun, and more particularly, to a nozzle structure that has a guide face to apply paint to a wider and larger area.

(2) Descriptions of Related Art

The conventional spray gun 10 is disclosed in FIGS. 1 to 3 and generally comprises a nozzle 11 from which the atomized paint is sprayed. An air cap 12 and a board 13 are connected to the front end of the nozzle 11, and are positioned by a cover 14 which is threadedly connected to the front end of the spray gun 10. The air cap 12 has a central path 121 and multiple sub-paths 122 and air paths 123 as shown in FIG. 2. The nozzle 11 has a paint path 112 and a probe 113, paint is located in the paint path 112 and the probe 113 has a cone-shaped tip. The board 13 has a cross-shaped aperture 131 to atomize the paint from the nozzle 11. The air cap 12 is rotatable to adjust the shape of the stream of the paint from the nozzle 11. An atomized paint spray is formed by allowing the air to pass the air path 123, and blocking the air through the sub-paths 122 of the air cap 12. Alternatively, by rotating the air cap 12 to allow the air to pass through the sub-paths 122 of the air cap 12, and to block the air to pass through the air path 123, an atomized paint stream is formed. When using the spray gun 10, the air pressure pushes the air cap 12 and the board 13 forward so that the air cap 12 is matched with the board 13, by the Siphon principle, the air is ejected from the gap 111 between the central path 121 and the nozzle 11, so that the paint in the paint path 112 is sprayed out from the nozzle 11. Because the cover 14 positions the air cap 12 and the board 13 by way of threading, so that when rotating the cover 14, the atomized paint spray can be obtained.

As shown in FIG. 4, the conventional spray gun can only have a fixed pattern of the spray which can be applied to a limited area.

FIG. 5 shows another spray gun which generates a flat stream from the nozzle 20, and comprises an air board 21, a nozzle 22 with a probe 221, a cover 23 and a tapered mask 24. The cover 23 has an elongate opening 231 which includes a first axis and a second axis which is shorter than the first axis. The probe 221 is located in the narrow opening 241 of the tapered mask 24, and the narrow opening 241 is located in the elongate opening 231 so that the area that the paint spray can be applied is increased. Because the elongate opening 231, the probe 221 and narrow opening 241 are elongate so that the area of the spray is extended, so that the area that the spray is covered is larger than the circular area that the conventional spray gun makes. This improvement saves time and the cost of labors.

The direction that the air stream of the spray gun in FIG. 5 is not changed when compared with that in FIG. 1, what is changed is the shape of the elongate opening 231, the probe 221 and narrow opening 241. However, the change of these parts cannot be installed to most of the conventional spray guns. Besides, the elongate opening 231, the probe 221 and narrow opening 241 have fixed shapes, the area that the spray can be applied cannot be adjusted or increased.

The present invention intends to provide a spray gun with the nozzle of the present invention which eliminates the shortcomings mentioned above.

SUMMARY OF THE INVENTION

The present invention relates to a nozzle of a spray gun, and comprises an air cap having a central path, multiple sub-paths and multiple air paths. The central path is a circular hole and defined centrally through the air cap. The air paths are located around the central path. Two protrusions extend from the front face of the air cap and each have the air paths defined therethrough. A board is located on the rear face of the air cap and has multiple apertures defined therethrough. A cover is threadedly connected to the end of a spray gun and positions the air cap and the board to the spray gun. A nozzle is located at the front end of the spay gun and has a paint path and a probe which extends through the board, the central path of the air cap and the cover. The central path of the air cap has a first inner periphery and a second inner periphery which is larger than the first inner periphery. The first inner periphery is located at the front end of the air cap and defines the circular hole. Two guide faces each are a tapered face which is connected between the first and second inner peripheries of the central path of the air cap. The two guide faces are located symmetrically relative to the central path. Two air holes are respectively defined between the two guide faces and the nozzle.

Because of the area change of the guide faces, the two streams of air flow hit head-to-head to increase the range of the air flow in the vertical direction. The air flow with wider and longer range brings the paint in the paint path to be sprayed out and applied to a larger area.

The primary object of the present invention is to provide a nozzle which has two guide faces to increase the spray area so as to save time and labor cost.

Another object of the present invention is to provide a nozzle which can be used with the existed spray guns without changing the parts of the spray guns. Only the air cap is needed to be replaced.

Yet another object of the present invention is to provide a nozzle wherein the area of the guide faces can be set according to the practical needs. Different air caps can meet different spray needs.

A further object of the present invention is to provide a nozzle wherein the nozzle or opening does not need to change, the guide faces change the direction of the air flow so as to increase the spray area.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
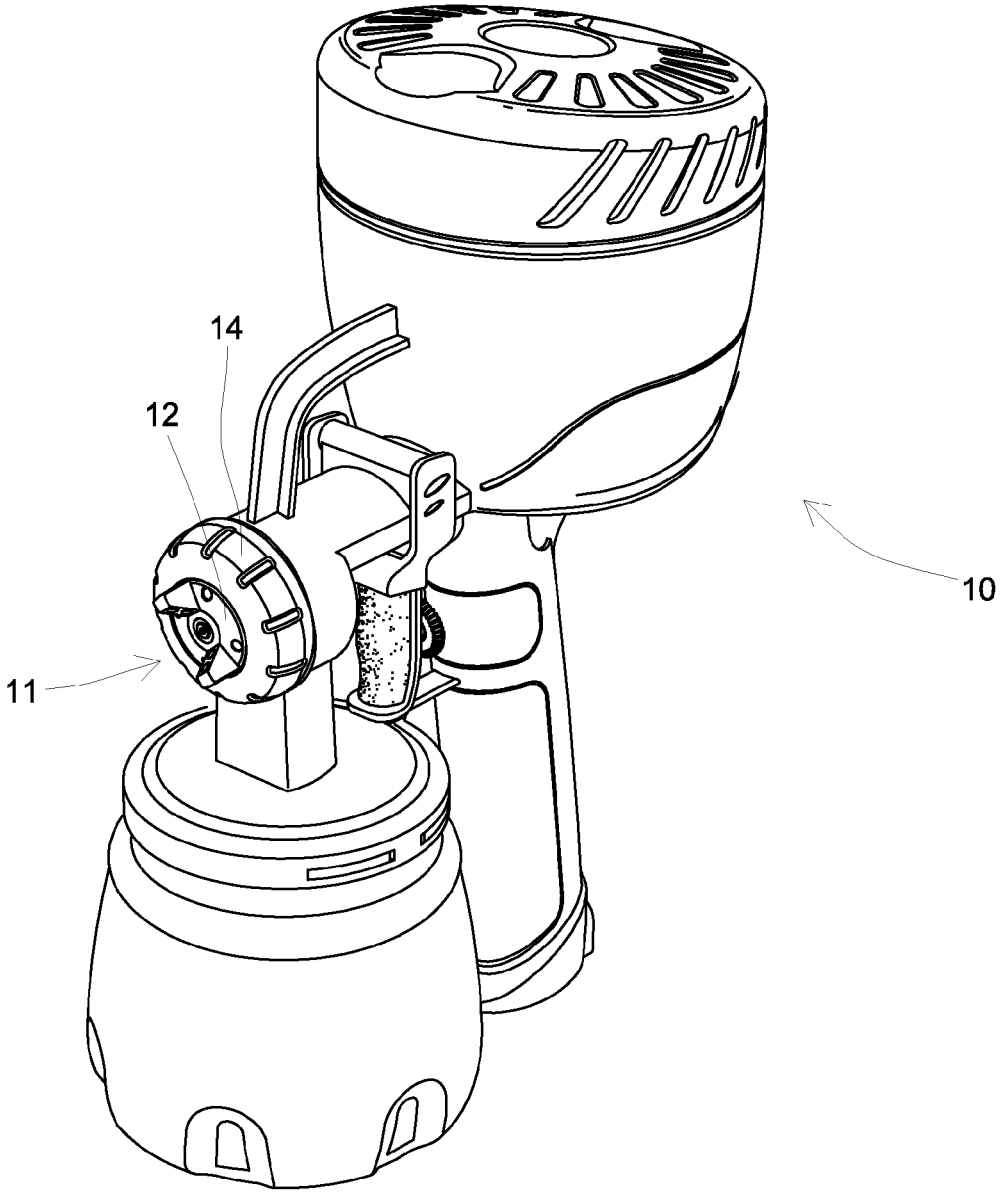
FIG.1 PRIOR ART
FIG. 1 is a perspective view to show the conventional spray gun.
Figure 2:
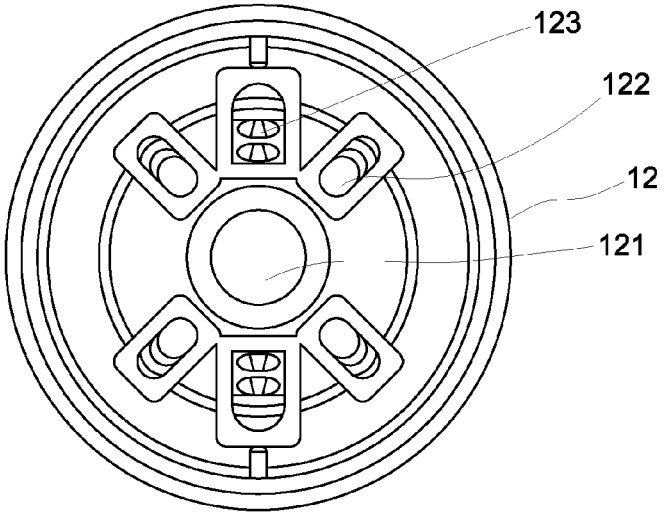
FIG.2 PRIOR ART
FIG. 2 shows the air cap of the conventional spray gun.
Figure 3:
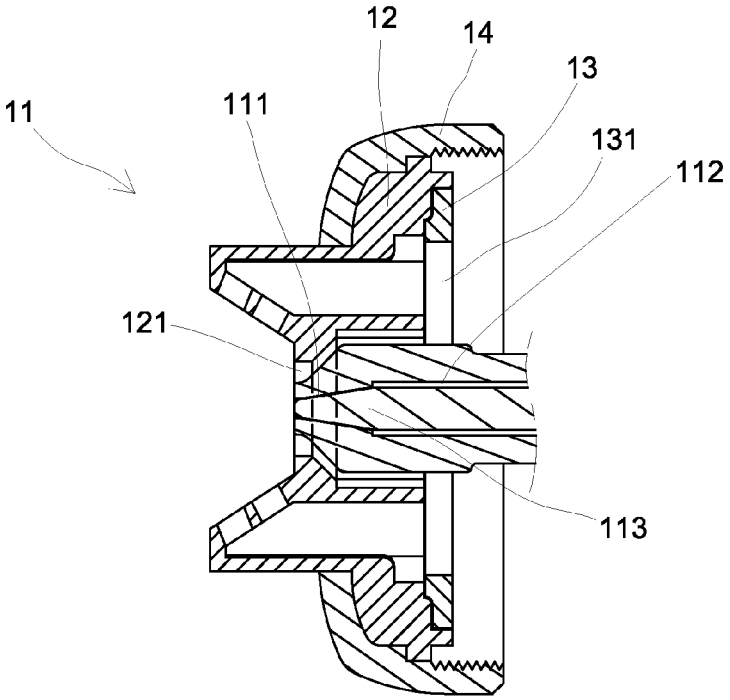
FIG.3 PRIOR ART
FIG. 3 is a cross sectional view of the conventional nozzle.

Referring to FIGS. 6 to 10, the nozzle of the present invention comprises an air cap 30, a board 40, a cover 50 and a nozzle 60. The air cap 30 has a central path 31, multiple sub-paths 32 and multiple air paths 33. The central path 31 is a circular hole and defined centrally through the air cap 30. The air paths 33 are located around the central path 31. Two protrusions 331 extend from the front face of the air cap 30 and each have the air paths 33 defined therethrough. The board 40 is a flat board and located on the rear face of the air cap 30. The board 40 has multiple apertures 41 defined therethrough which can be a cross-shaped apertures or rectangular aperture 41. The cover 50 is threadedly connected to the front end of a spray gun 300 and positions the air cap 30 and the board 40 to the spray gun 300. The spray gun 300 has a paint path 301 for receiving paint therein. The paint path 301 has a probe 61 located therein which extends through the board 40, the central path 31 of the air cap 30 and the cover 50. The air is introduced into the spray gun 300 by an electro-magnetic valve and the air flow passes through the gap between the central path 31 and the nozzle 60. The air flow passes through the central path 31 to bring the paint in the paint path 301 by the Siphon principle, and the paint is sprayed form the nozzle 60. The paint is atomized by rotating the air cap 30.

The central path 31 of the air cap 30 has a first inner periphery and a second inner periphery which is larger than the first inner periphery. The first inner periphery is located at the front end of the air cap 30. Both of the first and second inner peripheries of the central path 31 are a circular hole 311. Two guide faces 34 each are a tapered face which is connected between the first and second inner peripheries of the central path 31 of the air cap 30. The two guide faces 34 are located symmetrically relative to the central path 31. Two air holes 341 are respectively defined between the two guide faces 34 and the nozzle 60. The guide faces 34 each extend to the circular holes 311 of the first and second inner peripheries of the central path 31. The guide faces 34 each are a cone-shaped face.

Figure 4:
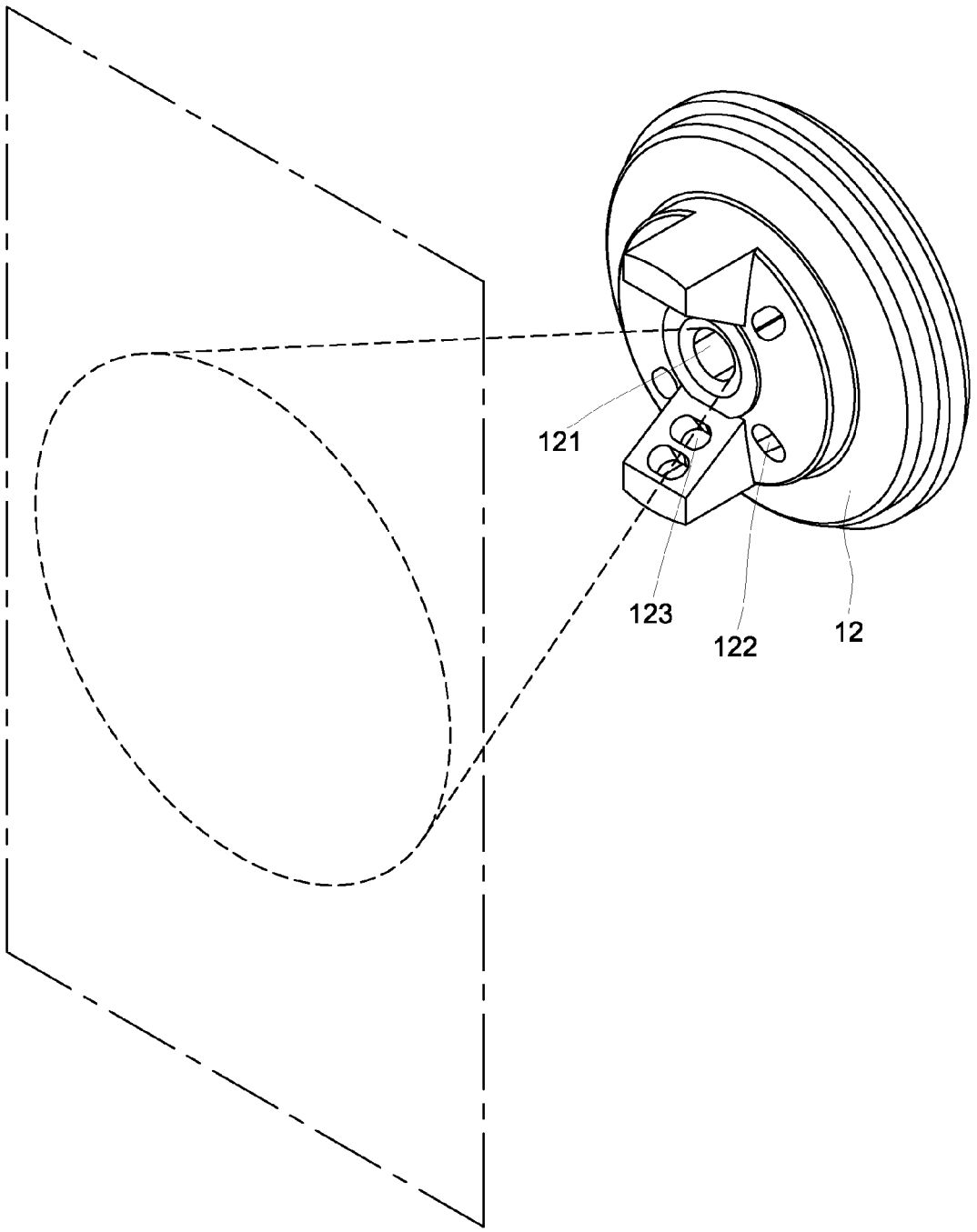
FIG.4 PRIOR ART
FIG. 4 shows the spray area that the conventional spray gun offers.
Figure 5:
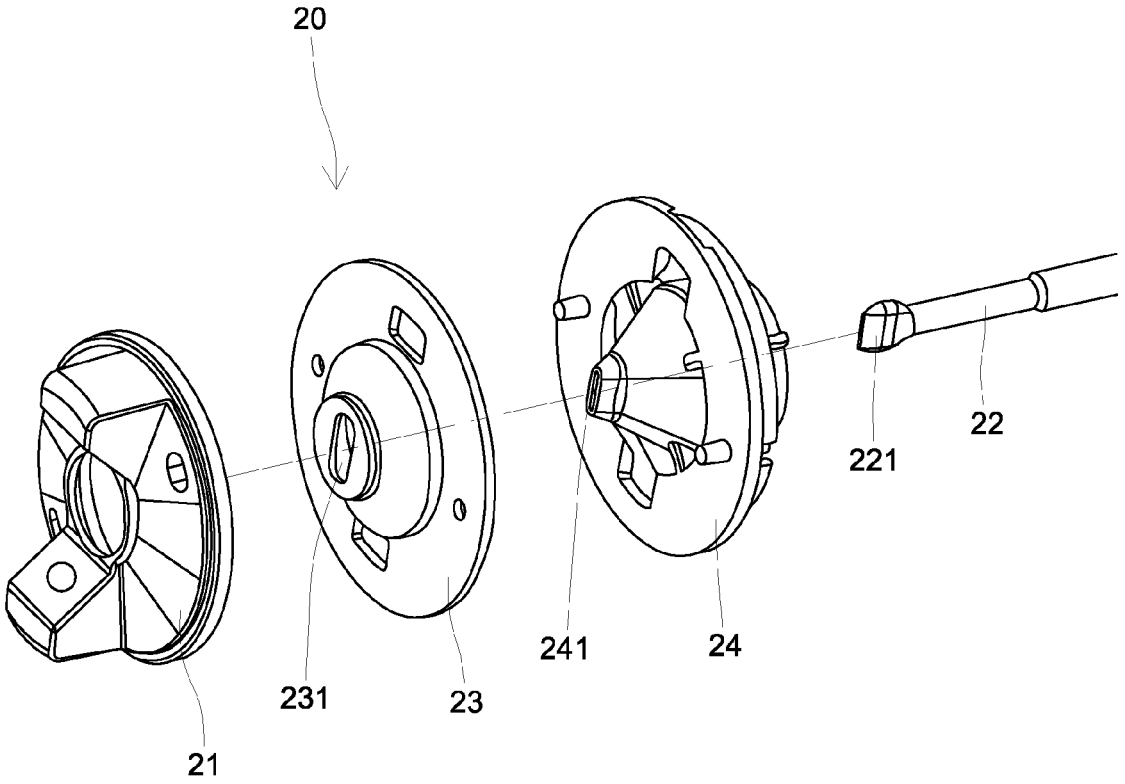
FIG.5 PRIOR ART
FIG. 5 is an exploded view of another conventional spray gun.
Figure 6:
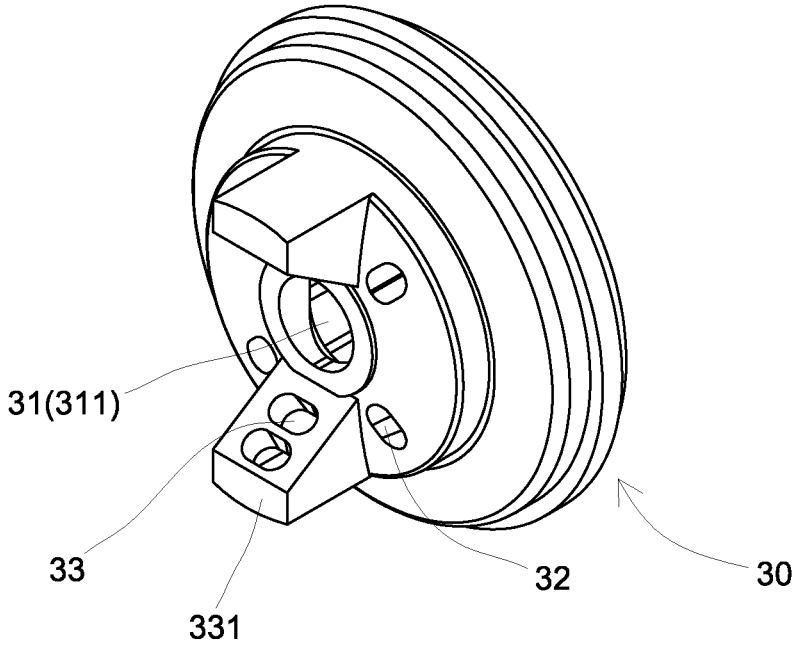
FIG. 6 is a perspective view to show the spray gun of the present invention.
Figure 7:
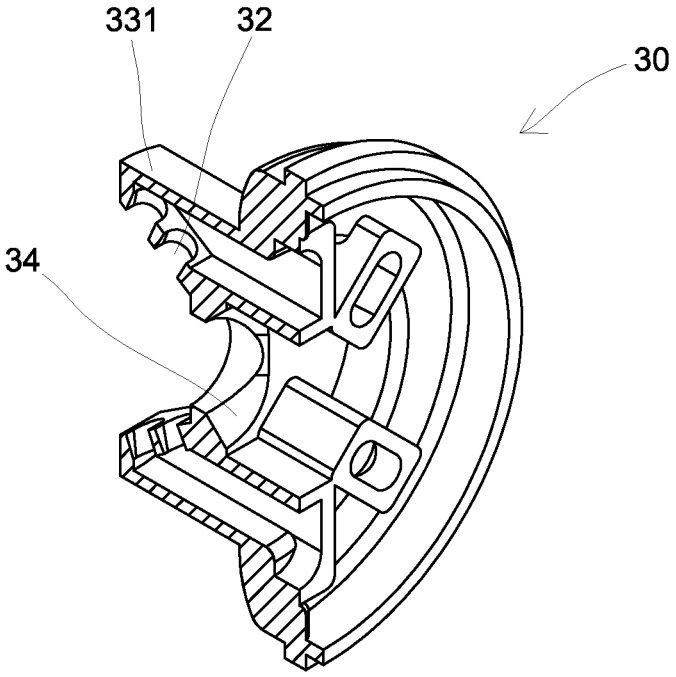
FIG. 7 shows the air cap of the spray gun of the present invention.
Figure 8:
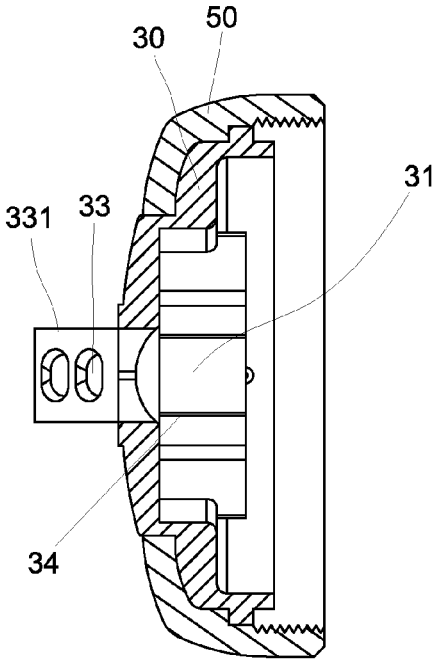
FIG. 8 is a cross sectional view to show the nozzle of the present invention.
Figure 9:
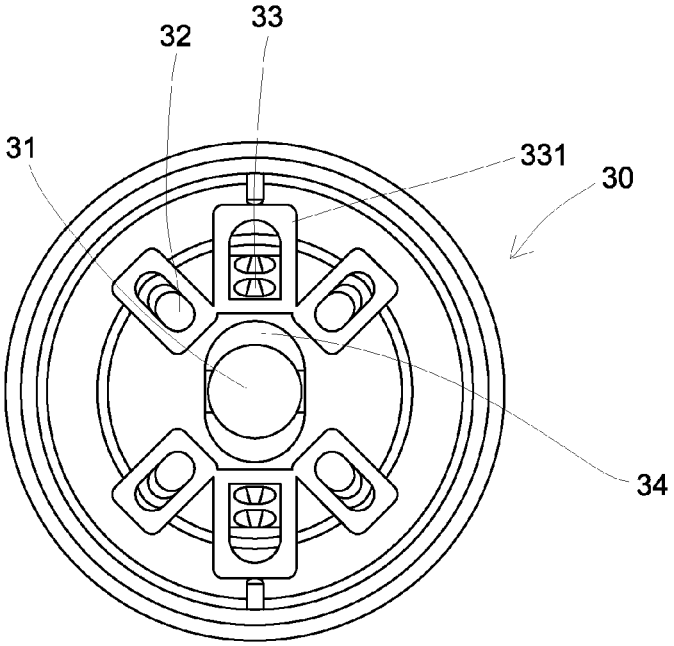
FIG. 9 shows the rear face of the air cap of the present invention.
Figure 10:
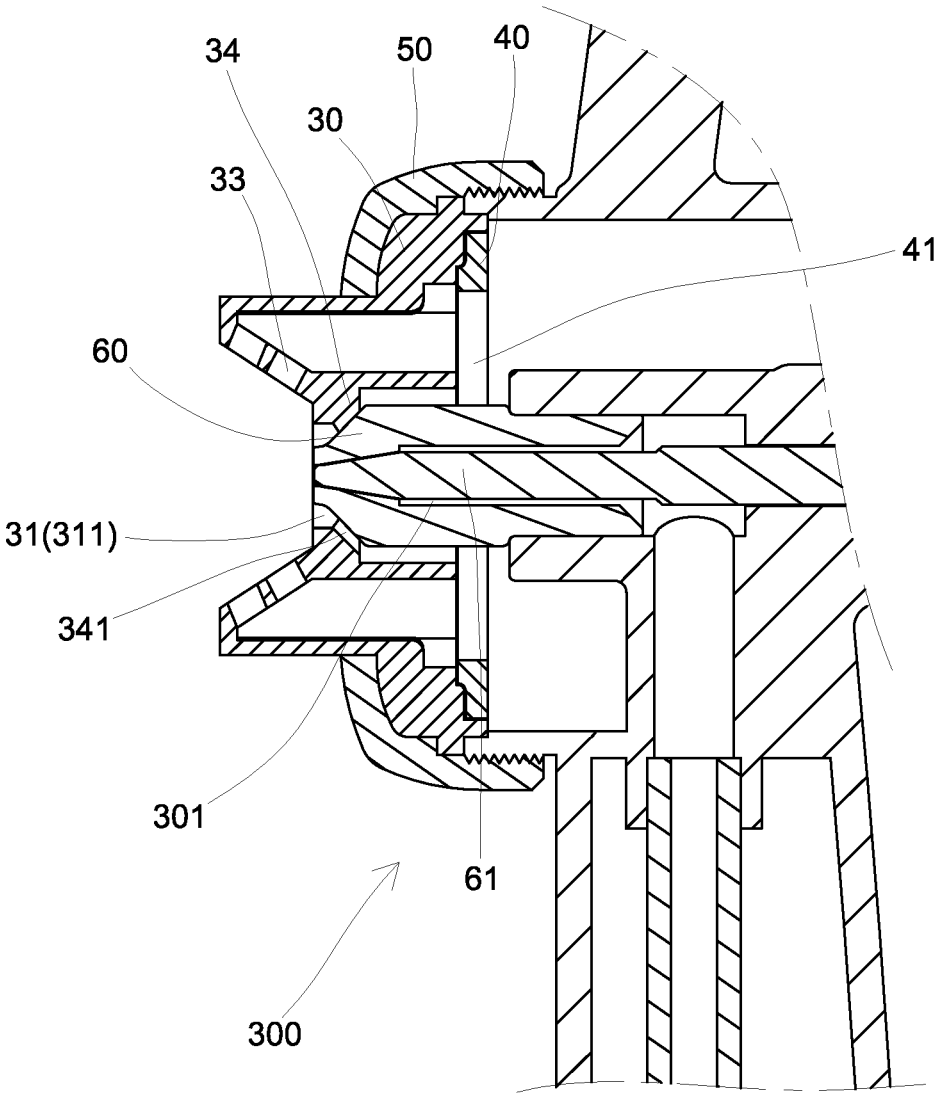
FIG. 10 is a cross sectional view to show the nozzle of the spray gun of the present invention.
Figure 11:
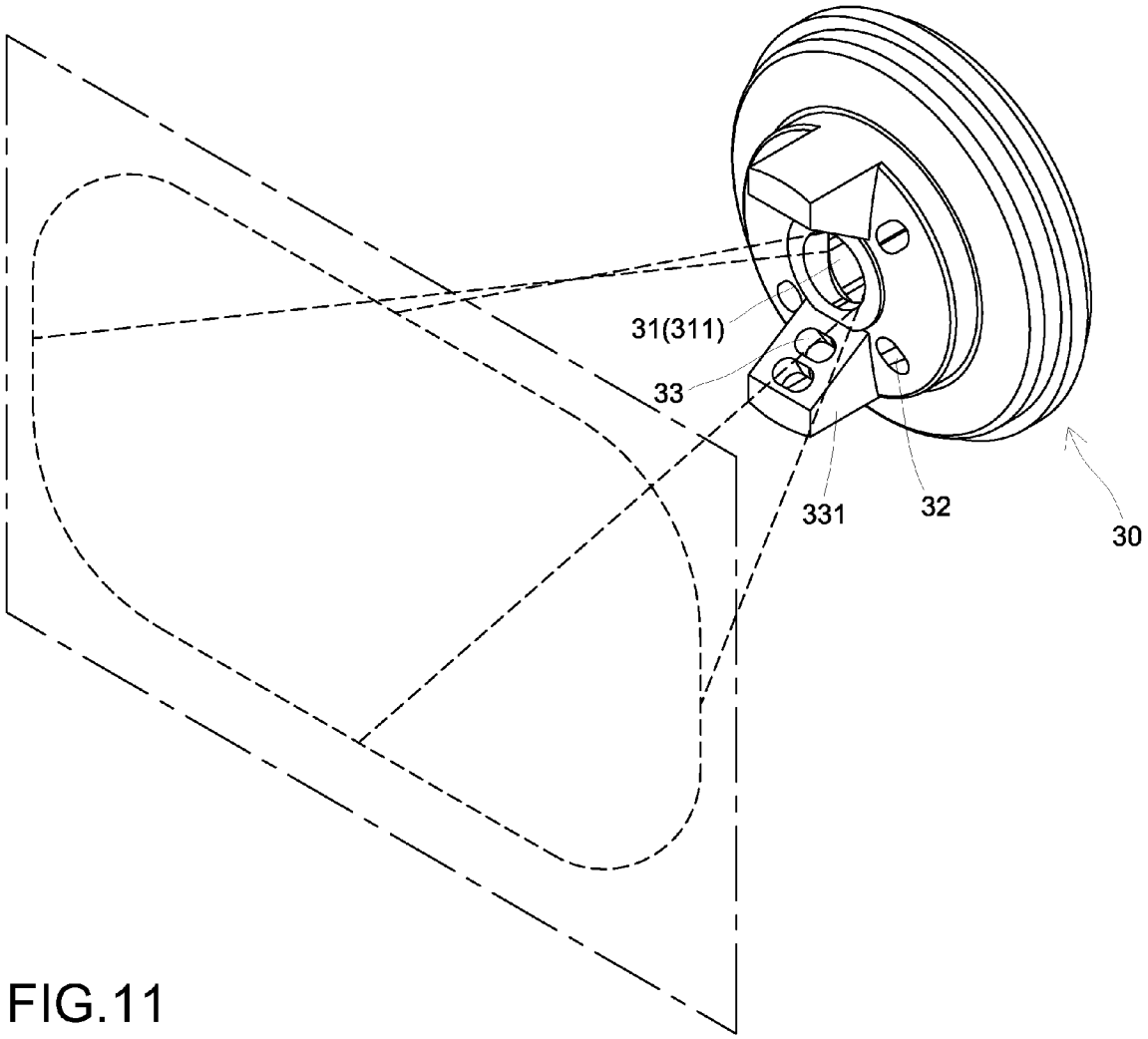
FIG. 11 shows the spray area of the nozzle of the spray gun of the present invention.

The guide faces 34 each provide a larger guide face in the central path 31 so that when the air flow reaches the central path 31 via the apertures 41 of the board 40, the air flow passes along the guide faces 34 and is ejected from the air holes 341. When two streams of air flow from the air holes 341 hit in opposite directions, the range of the two steams of the air flow is increased in the vertical direction. The atomized paint is also brought in horizontal direction to form a wider, longer and larger paint spray as shown in FIG. 11. The spray area is much larger than that when using the conventional spray gun as shown in FIG. 4.

The air cap 30 can be rotated 90 degrees to switch the guide faces 34 from the vertical direction to the horizontal direction, the area of the paint spray is changed accordingly.

The degree of taper of the guide faces 34 and the shape and/or size of the guide faces 34 can be set according to the practical needs to adjust the area that the atomized paint spray covers.

The two symmetric guide faces 34 change the spray area to increase the efficiency of the spray gun.

The nozzle of the present invention can be used with the existed spray guns without changing the parts of the spray guns. The same circular central path 31, the same cylindrical probe 61 of the nozzle 60, the same board 40 and the same cover 50 are maintained, only the air cap 30 is needed to be replaced.

The shape and size of the guide faces 34 of the air cap 30 can be varied to adjust the area to be sprayed.

The larger spray area is achieved by changing the direction of the air flow, not the nozzle or opening.

The nozzle of the present invention saves time and increases efficiency of work.

While we have shown and described the embodiment in accordance with the present invention, it should be clear to those skilled in the art that further embodiments may be made without departing from the scope of the present invention.

What is claimed is:

1. A nozzle of a spray gun, comprising:

an air cap having a central path, multiple sub-paths and multiple air paths, the central path being a circular hole and defined centrally through the air cap, the air paths located around the central path, two protrusions extending from a front face of the air cap and each having the air paths defined therethrough;

a board located on a rear face of the air cap and having multiple apertures defined therethrough;

a cover threadedly adapted to be connected to a front end of a spray gun to position the air cap and the board;

a nozzle adapted to be located at the front end of the spay gun and having a paint path and a probe which extends through the board, the central path of the air cap and the cover, and the central path of the air cap having a first inner periphery and a second inner periphery which is larger than the first inner periphery, the first inner periphery located at the front end of the air cap, both of the first and second inner peripheries of the central path being a circular hole, two guide faces each being a tapered face which is connected between the first and second inner peripheries of the central path of the air cap, the two guide faces located symmetrically relative to the central path, two air holes respectively defined between the two guide faces and the nozzle.

2. The nozzle as claimed in claim 1, wherein the guide faces each extend to the circular holes of the first and second inner peripheries of the central path, each of the guide faces is a cone-shaped face.

* * * * *